US005497930A

United States Patent [19]

Kubota

[11] Patent Number: 5,497,930

[45] Date of Patent: Mar. 12, 1996

[54] TAG ATTACHER

[75] Inventor: Mikio Kubota, Tokyo, Japan

[73] Assignee: Toska Co., Ltd., Tokyo, Japan

[21] Appl. No.: 161,424

[22] Filed: Dec. 6, 1993

[30] Foreign Application Priority Data

Mar. 9, 1993 [JP] Japan ..... 5-47970

[51] Int. Cl.[6] ..... B25C 1/00

[52] U.S. Cl. ..... 227/67

[58] Field of Search ..... 227/67, 71

[56] References Cited

U.S. PATENT DOCUMENTS

| | | | |
|---|---|---|---|
| 4,592,500 | 6/1986 | Kato | 227/67 |
| 4,651,913 | 3/1987 | Bone | 227/67 |
| 4,664,306 | 5/1987 | Levy | 227/67 |
| 4,802,152 | 2/1989 | Lee | 227/67 |
| 4,969,589 | 11/1990 | Kim | 227/67 |
| 4,988,335 | 1/1991 | Prindle | 227/67 |
| 5,020,713 | 6/1991 | Kanreuther | 227/67 |
| 5,152,445 | 10/1992 | Furutsu | 227/67 |

*Primary Examiner*—Scott A. Smith

*Attorney, Agent, or Firm*—Nikaido Marmelstein Murray & Oram

[57] ABSTRACT

A tag attacher constructed so that a feed member (18) from which a tooth (18*f*) engageable with a connecting portion (c) of a tag pin (t) projects and a stopper member (19) from which a tooth (19*c*) engageable in parallel with the tooth (18*f*) with the connecting portion projects extend in parallel with each other, the feed member (18) having a head portion (18*a*) and a lever portion (18*b*) extended from the head portion (18*a*), the feed member (18) being turned directly in accordance with the forward and backward movements of a movable member (9) so as to transfer the tag pin (t) to a predetermined position.

6 Claims, 9 Drawing Sheets

TAG ATTACHER

BACKGROUND OF THE INVENTION

This invention relates to an improvement in a tag attacher for use in attaching tags to articles of commerce, such as clothes.

In order to attach a tag to a delicate article of commerce, such as expensive clothes, a method of attaching a tag to an article with a thread is employed, and tag fasteners of a synthetic resin, i.e. tag pins consisting of such a material are generally used for the purpose of attaching tags to a large number of articles efficiently.

This tag pin is obtained by molding a synthetic resin, such as nylon and polypropylene, the strength of which increases as it is stretched, into an integral tag pin body in which a flat head portion, a filament portion extending from an intermediate part of the head portion at right angles thereto, and a lateral bar portion fixed to an end of the filament portion so as to extend at right angles to the filament portion are arranged substantially in the shape of the letter "H". Such a tag pin is molded as a member of an integral tag pin unit, which consists of 30 to 100 tag pins implanted in a comb-like arrangement in one connecting bar, for the purpose of conveniently molding the tag pins and loading them into a tag attacher.

Such tag pins in a tag pin unit generally used and having head portions of, for example, around 1 mm in thickness are implanted at regular intervals of 2 mm in a connecting bar. In this tag unit in which tag pins are arranged at the mentioned intervals, a space of around 1 mm in width is formed between adjacent tag pins. Therefore, when a plurality of tag pin units are put together, for example, when a plurality of tag pin units are inserted into one box, or when a plurality of tag pin units are taken out of a box and practically used with the remaining unused tag pin units thereafter inserted into the original box, the tag pins in different tag pin units get one among another to be entangled.

So-called connected pins in which the head portions of tag pins are joined together by connectors which can be cut off when the tag pins are practically used have also been proposed as tag pins used to prevent such entanglement thereof. In a tag pin unit having tag pins thus formed, lateral bar portions are joined together by connecting bars, and head portions directly, so that this tag pin unit can be handled as a single block. Accordingly, the head portions of the tag pins in one tag pin unit do not get into the spaces among those of the tag pins in another when the tag pin units are put together, i.e., these tag pins are used conveniently without causing the entanglement thereof to occur.

A tag pin unit having tag pins formed at regular intervals of 2 mm as mentioned above is considerably long. Therefore, when the tag pin unit is loaded into a tag attacher, it is held in an easily shakable condition in a front upper portion of the machine. Consequently, various problems arise, for example, a tag pin unit obstructs a tag attaching operation, and the connecting bars projecting from the lower side of a front portion of a tag attacher catch an article of commerce.

In order to solve these problems, the applicant of this invention has developed and sold a so-called closely spaced tag pins the pitch of which is set to as small as around 1 mm. These closely spaced tag pins are formed much more compactly than tag pins of 2 mm pitch, and this enables the material cost to decrease, and a packaging material to be miniaturized. Such tag pins can be stored in large quantities in the same box, transported easily and handled excellently.

Various types of tag attachers to which such tag pins can be applied have been proposed, an example of which is disclosed in Japanese Patent Publication No. 61-35051. This tag attacher was developed for the purpose of driving, especially, closely spaced tag pins into articles, and have been used practically enjoying favorable reception from the users as a machine having such excellent functions that are not provided in a prior art tag attacher. However, this tag attacher has to transfer such delicate tag pin units that were not available before, so that a tag pin unit feed means has to use a large number of precision parts. Due to this disadvantageous point, the cost of manufacturing the tag attacher increases.

Concretely speaking, this tag pin unit feeding means constitutes a precision machine requiring various kinds of precision parts, such as a slide bar driven by an intermediate lever, a support plate moved pivotally by the slide bar, a locking claw-carrying feed member placed on the support plate, a detent for stopping tag pin units so that the tag pin units are not moved up in concert with a movement of the locking claw when the locking claw is moved up so as to engage the lateral bar of an upper tag pin in the tag pin unit, and a spring urging the detent in the forward direction.

The cost of manufacturing this tag attacher provided with a tag pin unit feed means in which a large number of parts are thus combined becomes high as a matter of course. In addition, attention has to be paid thoroughly to the handling of the tag attacher since it is a precision apparatus. Moreover, a lot of parts are worn during the use of the tag attacher, and errors occur in the movements of the parts, the movement of each part lacking smoothness to cause a tag pin to be driven erroneously in some cases.

The present invention aims at providing a tag attacher capable of eliminating the drawbacks encountered in the above-described conventional tag attacher, i.e. a tagging gun, and having a high durability and free from errors in tag pin driving actions owing to the use of a very simplified feed means.

SUMMARY OF THE INVENTION

The tag attacher according to the present invention which has been developed with a view to achieving this object is constructed so that a movable member 9 having a piston 11 at the front side thereof is driven forward by an intermediate lever 5 adapted to be turned by a lever 3 which is supported pivotably so that the lever 3 projects forward from and retracts into a grip 2 extended downward from a tag attacher body 1, to drive a lateral bar of a tag pin by the piston 11 into a hollow needle 12 provided in a front portion of the tag attacher body 1, in which tag attacher a feed member 18 from which a tooth 18*f* engageable with a connecting portion of a tag pin projects and a stopper member 19 from which a tooth 19*c* engageable in parallel with the tooth 18*f* with the connecting portion projects are provided in parallel with each other, the feed member 18 having a head portion 18*a* and a lever portion 18*b* extended from the head portion 18*a*, the feed member 18 being rocked in accordance with forward and backward movements of the movable member 9 so as to transfer the tag pin to a predetermined position.

More concretely, the feed member 18 from which the tooth 18*f* engageable with a connecting portion of a tag pin projects and the stopper member 19 from which the tooth 19*c* engageable in parallel with the tooth 18*f* with the connecting portion are provided in parallel with each other in a guide recess 14 formed in a front portion of the tag attacher body 1, and the feed member 18 has the lever portion 18*b* extended from the head portion 18*a*, a shaft portion 18*d* via which the head portion 18*a* is supported pivotably on the tag attacher body 1, and a receiving portion 18*j* formed in a position away from the shaft portion 18*d*, the stopper member 19 being supported pivotably on the tag attacher body 1 via a projection 19*b*, the movable member 9 being moved forward to press the receiving portion 18*j* so that the tooth 18*f* is lifted to engage an upper connecting portion, the movable member being moved back to lift the lever portion 18*b* so that the tag pin unit engaged with the tooth 18*f* is lowered by a distance corresponding to the width of one connecting portion.

The lever 3 is grasped tightly to move the movable member 9 or the intermediate lever 5 forward and turn the head portion 18*a* of the feed member 18 upward, and the lever 3 is released from the grasping force to move the movable member back and cause the lever portion 18*b* to be lifted and the head portion 18*a* to be lowered. During this time, one tag pin is fed as the tooth 18*f* projecting from the bead portion 18*a* is engaged with the connecting portion of the tag pin.

Since a tag pin is fed by turning the feed member 18 in accordance with the forward and backward movements of the movable member 9 or the intermediate lever 5, the feed means is noticeably simplified.

DESCRIPTION OF THE PREFERRED EMBODIMENT

An embodiment of the present invention will now be described with reference to the drawings.

Figure 1:
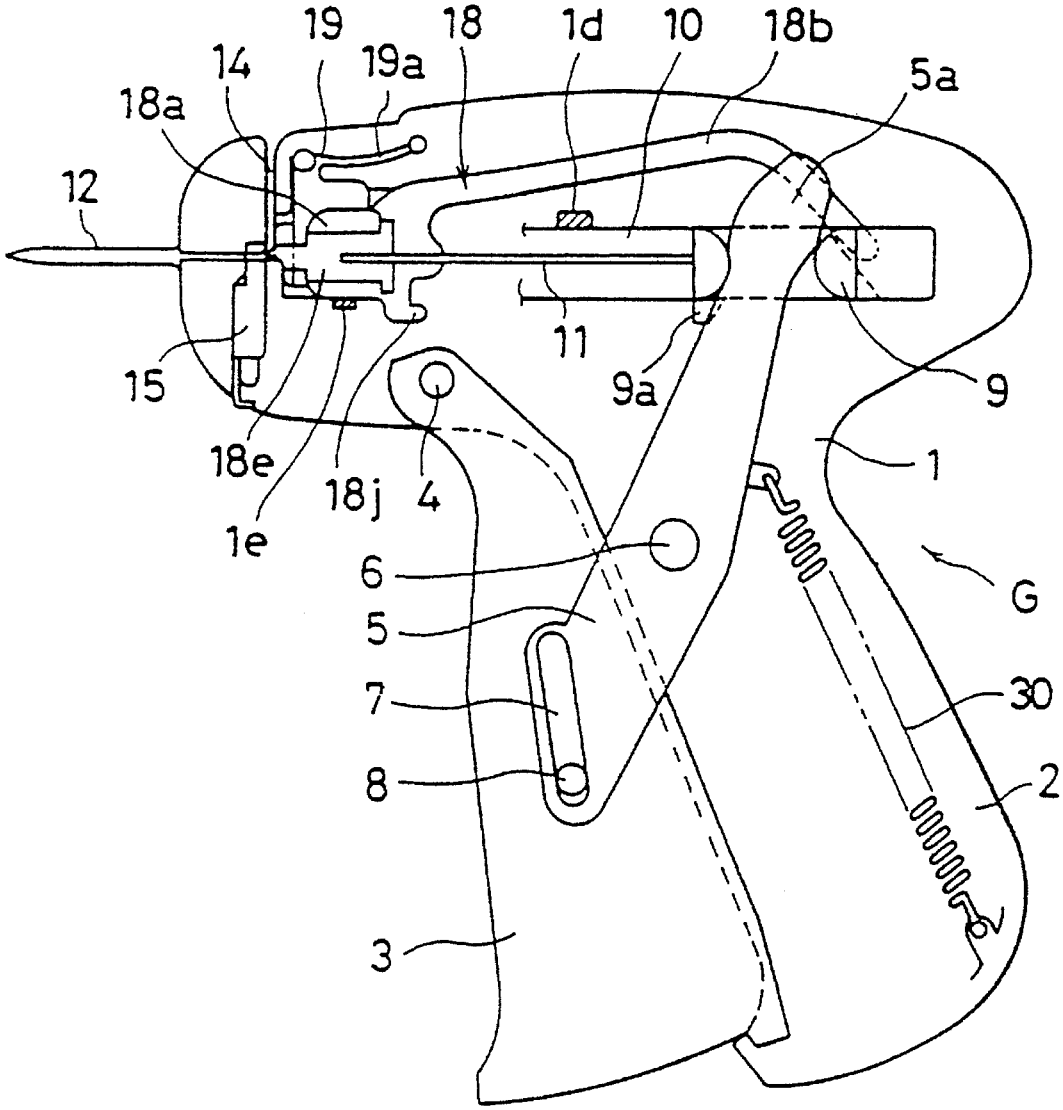
FIG. 1 is a side elevation of a principal portion of an embodiment of the tag attacher according to the present invention.
Figure 2:
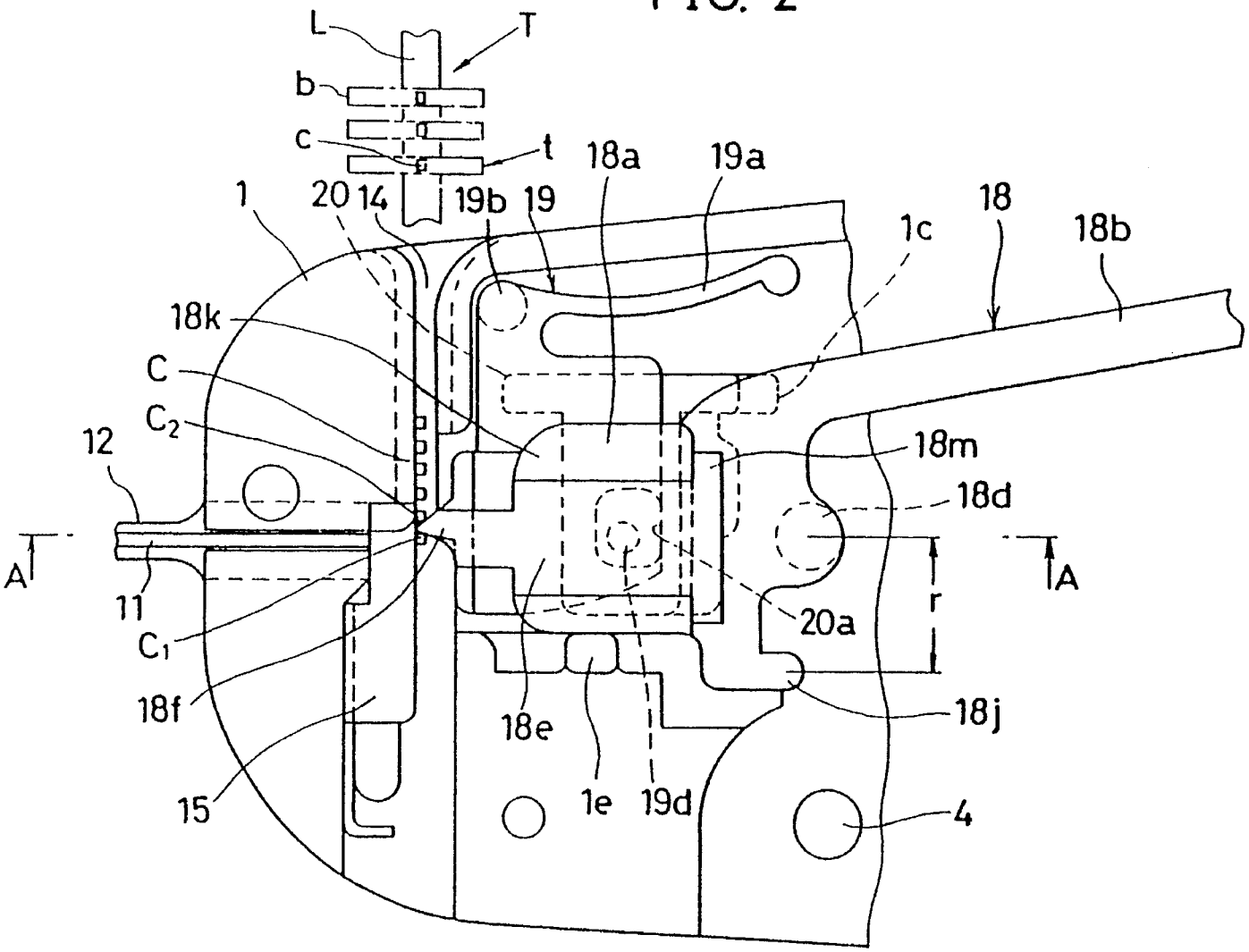
FIG. 2 is an enlarged view of a principal portion of the embodiment of FIG. 1.

Referring to FIGS. 1 and 2 showing a first embodiment of the present invention, a tag attacher body 1 is formed in the shape of a pistol, and a lever 3 is supported pivotably on a front portion of a grip 2 thereof via a shaft 4 and urged by a spring 30 so as to project forward. An intermediate lever 5 is supported pivotably via a shaft 6 on the portion of the grip which is behind the lever 3, and a stepped pin 8 provided on the lever 3 is engaged with an elongated bore 7 formed in a lower portion of the intermediate lever 5, to operatively connect the intermediate lever to the lever 3.

A movable member 9 fitted in a guide groove 10 formed in the inner surface of the tag attacher body 1 is engaged with a head portion 5*a* of the intermediate lever 5, and a piston 11 (rod) consisting of a metal rod is provided in front of the movable member 9 and adapted to advance into the interior of a hollow needle 12 provided on the front end of the tag attacher 1. A guide groove 14 (cross-sectionally a T-shaped groove for guiding a connecting bar, a connecting portion, a lateral bar portion, and a root part of a filament portion of a tag pin unit) into which a tag pin unit is loaded vertically is provided in a front portion of the tag attacher body 1. A cutting blade 15 is provided detachably on the portion of the tag attacher body which is on the opposite side of the guide recess 14 and away from the area through which the piston 11 passes.

This cutting blade 15 is provided for the purpose of cutting a connecting portion extending between a connecting bar and a lateral bar portion of a tag pin when one tag pin is pushed by the piston 11 and forced into the hollow needle 12, and it is used in a regular tag attacher.

A tag pin feed means employed in the tag attacher according to the present invention will now be described.

As shown in FIG. 2 as well, this feed means consists of a feed member 18 composed of a main portion molded out of a synthetic resin and a toothed member composed of a metal plate, and a stopper member 19 molded out of a synthetic resin. Further, these members may be formed out of materials which suit the functions thereof and which are selected with the material costs taken into consideration.

Figure 3:
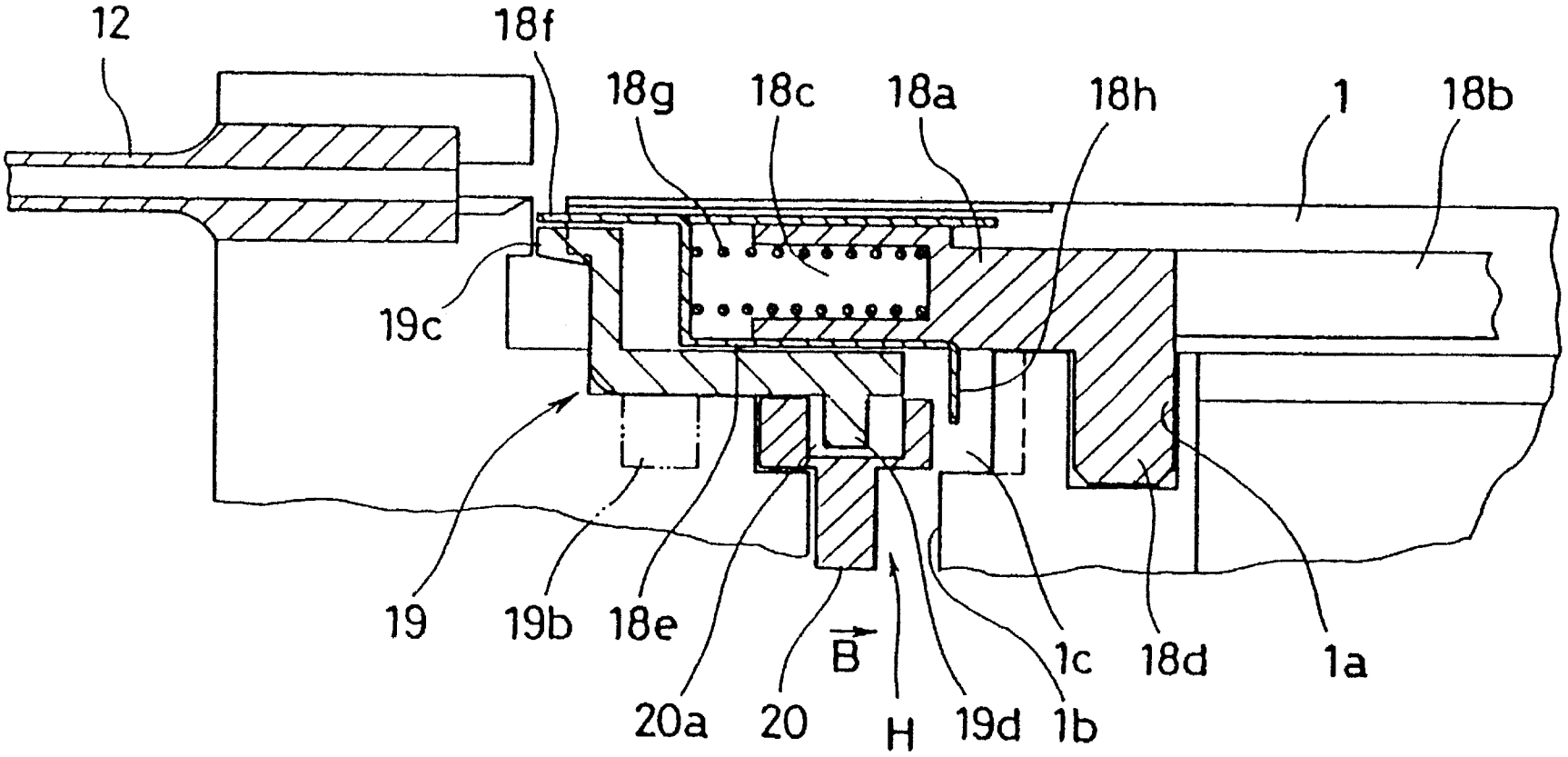
FIG. 3 is a sectional view taken along the line A—A in FIG. 2.

The feed member 18 consists of a head portion 18*a* and a thin lever portion 18*b* extending from the head portion 18*a* in the backward direction in the form of a bow of a pair of spectacles, and is provided with a bore 18*c* opened in the forward direction of the head portion 18*a* as shown in FIG. 3 (sectional view taken along the line A—A in FIG. 2), and a shaft portion 18*d* projecting from a side surface of the head portion 18*a* and fitted in a bearing la provided in the tag attacher body 1.

As shown in FIG. 1, stoppers 1*d*, 1*e* are provided on the tag attacher body 1, and the stoppers 1*d*, 1*e* are adapted to stop a downward movement of the lever portion 18*b* and a downward movement of the head portion 18*a* respectively and restrict the feed member 18 so that the feed member 18 makes swinging movements in the vertical direction in the drawing between these stoppers 1*d*, 1*e*.

A toothed member 18*e* having a tooth 18*f* at the front end thereof is provided so as to extend along the side surfaces of the head portion 18*a* and project forward, and a coiled spring 18*g* is provided in a compressed state between the inner surface of the toothed member 18*e* and the rear surface of the bore 18*c* as shown in FIG. 3, so as to project the toothed member 18*e* forward. As shown in FIG. 2, a receiving portion 18*j* is provided at the rear part of the head portion 18*a* which is a distance r away from the shaft portion 18*d*, and a pressing member 9*a* provided at a front part of the movable member 9 shown in FIG. 1 is adapted to engage this receiving portion and turn the head portion 18*a* vertically around the shaft portion 18*d*.

The toothed member 18*e* is formed by molding a metal plate to a cross-sectionally U-shaped body as shown in FIG.

Figure 7:
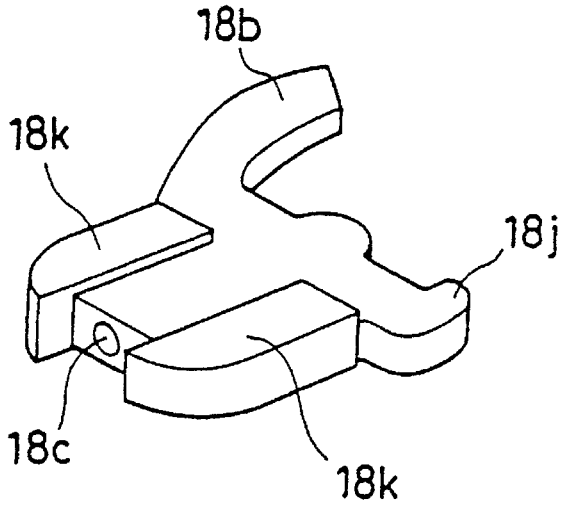
FIG. 7 is a perspective view of a head portion of a feed member.
Figure 8:
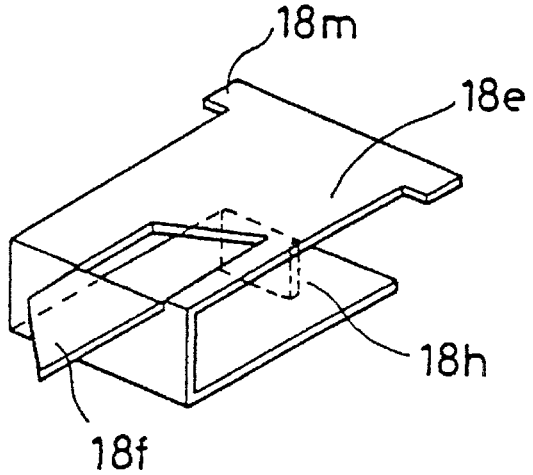
FIG. 8 is a perspective view of a toothed member provided on a front end portion of the feed member.

8, so as to have a tooth 18*f* projecting from the front portion thereof and a projection 18*h* extending from a rear portion thereof. The toothed member 18*e* is inserted between two projections 18*k* provided on the upper and lower surfaces of the head portion 18*a* as shown in FIGS. 2 and 7, and it is positioned with a rear projection 18*m* engaging the rear end portions of the projections 18*k*, the tooth 18*f* thereby engaging a connecting portion c of a tag pin.

The stopper member 19 is molded to an integral body out of a synthetic resin, and has a thinly extending spring portion 19*a* at the upper part thereof. A projection 19*b* (shaft) provided at a root part of the spring portion 19*a* is fitted in a bearing portion(recess) provided in the tag attacher body 1, to support the stopper member 19 pivotably. The stopper member 19 has a tooth 19*c* at the front lower portion thereof, the tooth 19*c* projecting as shown in FIG. 3. When a tag pin t is not fed as shown in FIG. 2, i.e., when the lever 3 is not grasped tightly, the tooth 18*f* provided at the front end of the toothed member 18*e* and this tooth 19*c* are in a juxtaposed state and fitted between connecting portions c1 and c2 by which the connecting bar L and lateral bar b of a tag pin t are joined together. Although the positions only of the connecting portions of a tag pin are drawn in FIG. 2, the tag pin unit used in this embodiment is identical with a conventional tag pin unit. Needless to say, these connecting portions are implanted in a connecting bar positioned on the reverse side of the surface of the drawing and a lateral bar portion is provided on front side thereof.

Figure 9:
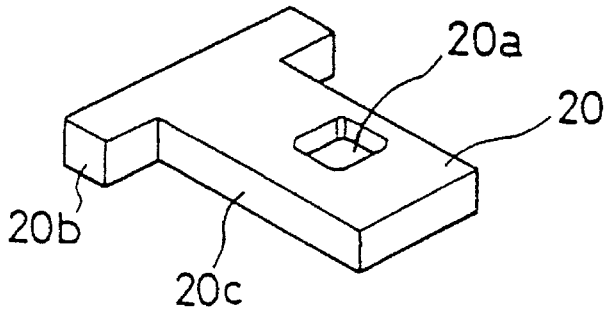
FIG. 9 is a perspective view of a tag pin unit releasing knob.

As shown in FIG. 3, the stopper member 19 is provided on its side surface with a projection 19*d*, which is engaged with a recess 20*a* in a knob 20 capable of being operated from the side surface of the tag attacher body 1. This knob 20 consists of a narrow lateral portion 20*b* and a wide vertical portion 20*c* as shown in FIGS. 2 and 9, and is fitted in a guide portion 1*c* provided in the tag attacher body 1. A projection provided on the side surface of the knob 20 extends through a bore 1*b* so that the knob 20 can be moved back within a clearance H.

When the knob 20 is moved back by a distance corresponding to the clearance H, the projection 18*h* formed at the rear portion of and integral with the toothed member 18*e* and the projection 19*d* held in the recess 20*a* of the stopper member 19 are engaged simultaneously, and the tooth 19*c* provided at the front end of the stopper member 19 and the tooth 18*f* provided at the front end of the toothed member 18*e* are moved back together to be disengaged from a connecting portion c of a tag pin, the tag pin being thus set free from the tag attacher body 1 and capable of being withdrawn from the upper side of the guide recess 14.

An operation for driving a tag pin into an article of commerce will now be described.

FIGS. 1 and 2 show the condition in which a tag pin t is yet to be driven into an article or the condition in which the driving of a tag pin into an article has been finished. In this condition, a known tag pin assembly T is loaded in the guide recess 14. Further, in FIG. 2 a portion of the tag pin assembly T and a portion of the connecting portions c thereof alone are shown.

The tooth 18*f* formed at the front end of the toothed member 18*e* is fitted between the connecting portion c1 of the leading (lowermost) tag pin and that c2 of a tag pin to be subsequently driven into an article. As shown in FIG. 3, the tooth 19*c* of the stopper member 19, which is laminated on the tooth 18*f*, is also fitted in the same manner between the two connecting portions c1, c2.

As shown in FIG. 2, a lateral bar portion b is provided on the front side of a connecting portion c with respect to the surface of the drawing, and a connecting bar L on the rear side thereof, the front half part of the lateral bar portion being inserted in the hollow needle 12. In this condition, the piston 11 stands by behind the hollow needle 12 as shown in FIG. 1.

Figure 4:
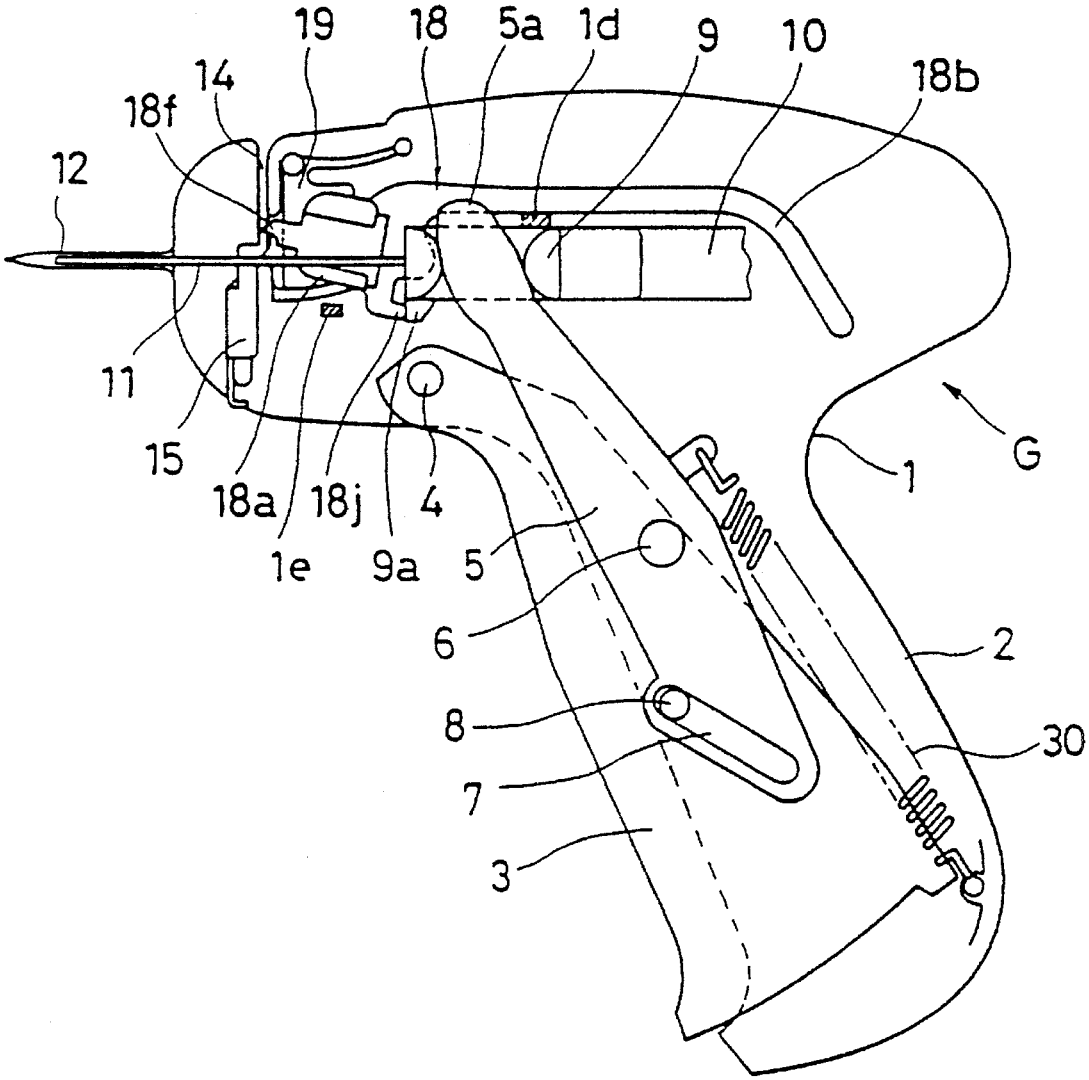
FIG. 4 is a side elevation, which corresponds to FIG. 1, of the embodiment in operation.
Figure 5:
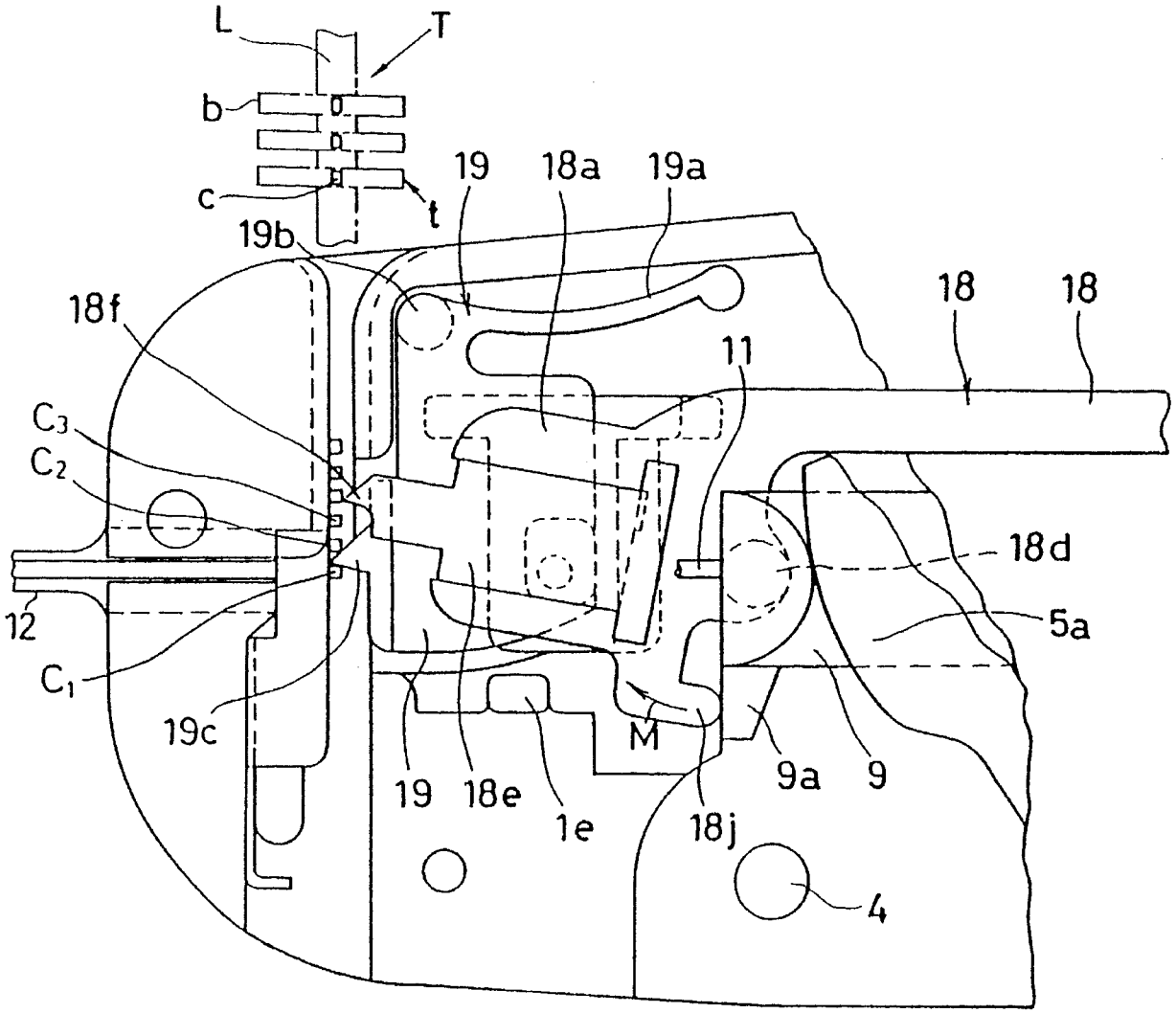
FIG. 5 is an enlarged view, which corresponds to FIG. 4, of the embodiment in operation.

FIGS. 4 and 5 show the condition in which the driving of one tag pin t into an article has been finished. When the lever 3 is triggered against the spring force of a spring 30 to cause a part thereof to enter the interior of the grip 2, the intermediate lever 5 is inclined forward due to the movement of the lever 3, and the movable member 9 engaged with the head portion 5*a* thereof advances forward to cause the piston 11, which projects from the front portion of the movable member 9, to move into the hollow needle 12, so that the lateral bar portion of a tag pin standing by at the inlet of the hollow needle 12 is forced into the interior thereof so as to project from the front end thereof.

In this condition, the hollow needle 12 is inserted through the hole of a tag placed on an article, and the connecting portion c of one leading tag pin t is cut off from a tag pin unit in accordance with the operation for grasping the lever 3, the lateral bar portion being pressed by the hollow needle 12 driven by the piston 11 to project from the rear side of the article, whereby the tag is attached to the article. During this time, the filament portion joined to the lateral bar portion is dragged forward as it projects from a slit extended in a side wall of the hollow needle 12.

The movable member 9 is moved forward in the above-mentioned manner, and the receiving portion 18*j* of the feed member 18 is pressed by the pressing member 9*a* provided at the front end of the movable member 9. Consequently, the head portion 18*a* supported pivotably on the shaft portion 18*d* is inclined upward due to the rotation moment M as shown in FIG. 5, and the tooth 18*f* projecting from the front end of the head portion 18*a* is moved up to a position above a third connecting portion c3 as it leaves from the guide recess 14. During this time, the lever portion 18*b* engages the stopper 1*d* as shown in FIG. 4, to be restricted with respect to the downward movement thereof. The feed member 18 is supported so that it is turned lightly around the shaft portion 18*d* as a fulcrum.

In the meantime, the tooth 19*c* formed at the front end of the stopper member 19 remains fitted between the first and second connecting portions c1, c2 as shown in FIG. 5, to hold the tag pin unit so that the tag pin unit is not moved with the tooth 18*f*, which projects from the front end of the toothed member 18*e*, when the tooth 18*f* is moved up.

As shown in FIGS. 4 and 5, when one tag pin t is driven into an article, the front part of the head portion 18*a* of the feed member 18 is turned up around the shaft portion 18*d* as fulcrum but the lever portion 18*b* engages the stopper 1*d* and is not inclined more than required.

When the lever 3 is then released from the gripping force, it restores the condition shown in FIGS. 1 and 2, owing to the force of a spring. During this time, the movable member 9 contacts the rear end part of the lever portion 18*b* to lift the same, so that the head portion 18*a* moves down the tooth 18*f* while projecting the same into the guide recess 14 as the head portion 18*a* is turned leftward around the shaft portion 18*d* as a fulcrum, the tooth 18*f* being moved down as it is engaged with the third connecting portion c3 (the second connecting portion c2 in the case where a tag pin assembly having tag pins of a conventional pitch is used).

In the above, in pressing the connecting portion c3 downwardly, the tooth 18*f* presses two connecting portions c2 and c3 downwardly, and while the head portion 18*a* is moved without rotating and stopped in contact against a stopper 1*e*, the lever portion 18*b* undergoes a flexing in that it is made of a synthetic resin and is flexible and the movable member 9 can return to its prescribed position while it presses the tag pin unit or assembly T downwardly within the guide groove 14.

During this time, the connecting portion c1 engaged with the tooth 19*c* of the stopper member 19 is pressed down in accordance with the downward movement of the tooth 18*f* to cause the subsequent connecting portion c2 and tooth 19*c* to engage each other, resulting in that a single tag pin t is fed to its shooting position. As shown in FIG. 5, the stopper 1*e* is provided on the tag attacher body 1 so as to support the lower part of the head portion 18*a* and, when the head portion 18*a* is moved down to its predetermined position as shown in FIG. 2, the movement thereof is restricted by this stopper 1*e*.

When the tag pin assembly T is moved forward by the feed member 18 during this operation, the stopper member 19 is turned leftward around the projection 19*b* as fulcrum (FIG. 2), and the tooth 19*c* feeds only one connecting portion c by its ratchet-like action as it is engaged therewith, by the resilient force of the spring portion 19*a* to a first tag pin t to the tag pin driving position or shooting position.

The tag pins t separated sequentially from the tag pin unit T loaded in the guide groove 14 in the front portion of the tag attacher body 1 are driven into articles one after another by repeating the operations shown in FIGS. 1 and 4, i.e., by repeating the standby condition and tag pin driving condition shown in FIGS. 2 and 5 respectively. This tag pin feed operation is carried out by inclining the head portion 18*a* of the feed member 18 upward by the movable member 9, and pressing the lever portion 18*b*, which extends rearward at the rear portion of the feed member 18, during a returning movement of the movable member 9 to cause the head portion 18*a* to be inclined downward automatically.

The removing of a tag pin unit, some of the tag pins of which have been driven into articles, from the tag attacher will now be described.

Figure 6:
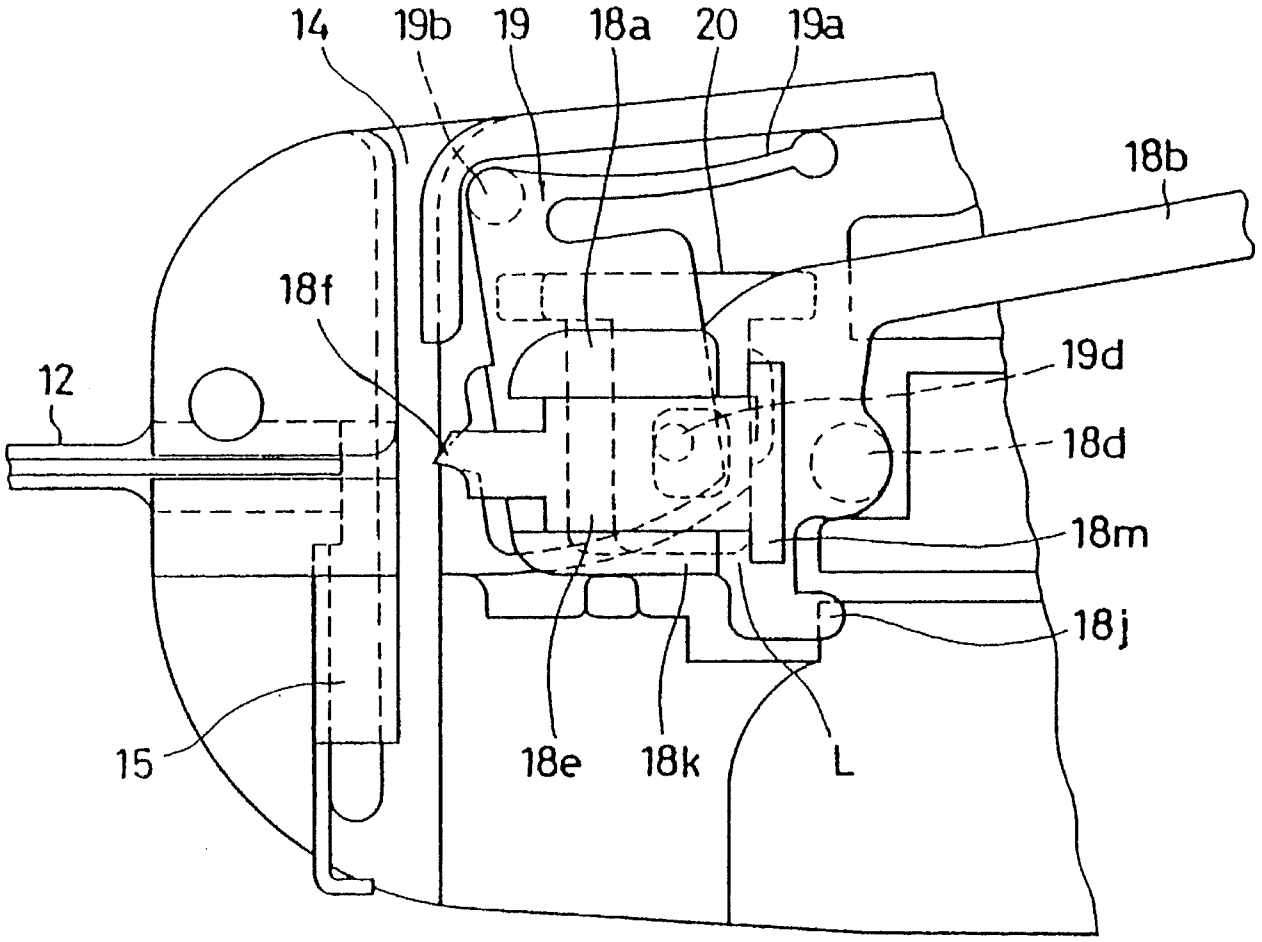
FIG. 6 is an enlarged view of a principal portion of the tag attacher with a tag pin unit set in a free state.

Referring to FIGS. 3 and 6, when the knob 20 is moved back in the direction of an arrow B, the toothed member 18*e* engaged therewith is moved back against the coiled spring 18*g* to form a clearance L between the projections 18*k*, 18*m*. The stopper member 19 is inclined rearward around the projection 19*b* as a fulcrum to move back the tooth 19*c*. When this condition has been attained, two teeth 18*f*, 19*c* are removed from the guide groove 14 and disengaged from the connecting portion c, and the tag pin unit T (FIG. 2) can be withdrawn upward along the guide groove 14.

When the positions of the stoppers 1*d*, 1*e* for limiting the vertical movements of the feed member 18 are determined properly with the shape of the lever portion 18*b*, which is operated by the movable member 9, designed properly, various tag pin units T having different respective pitches of tag pins can be used, and this enables a tag attacher applicable to tag pin units T having tag pins arranged at various intervals to be provided.

Figure 10:
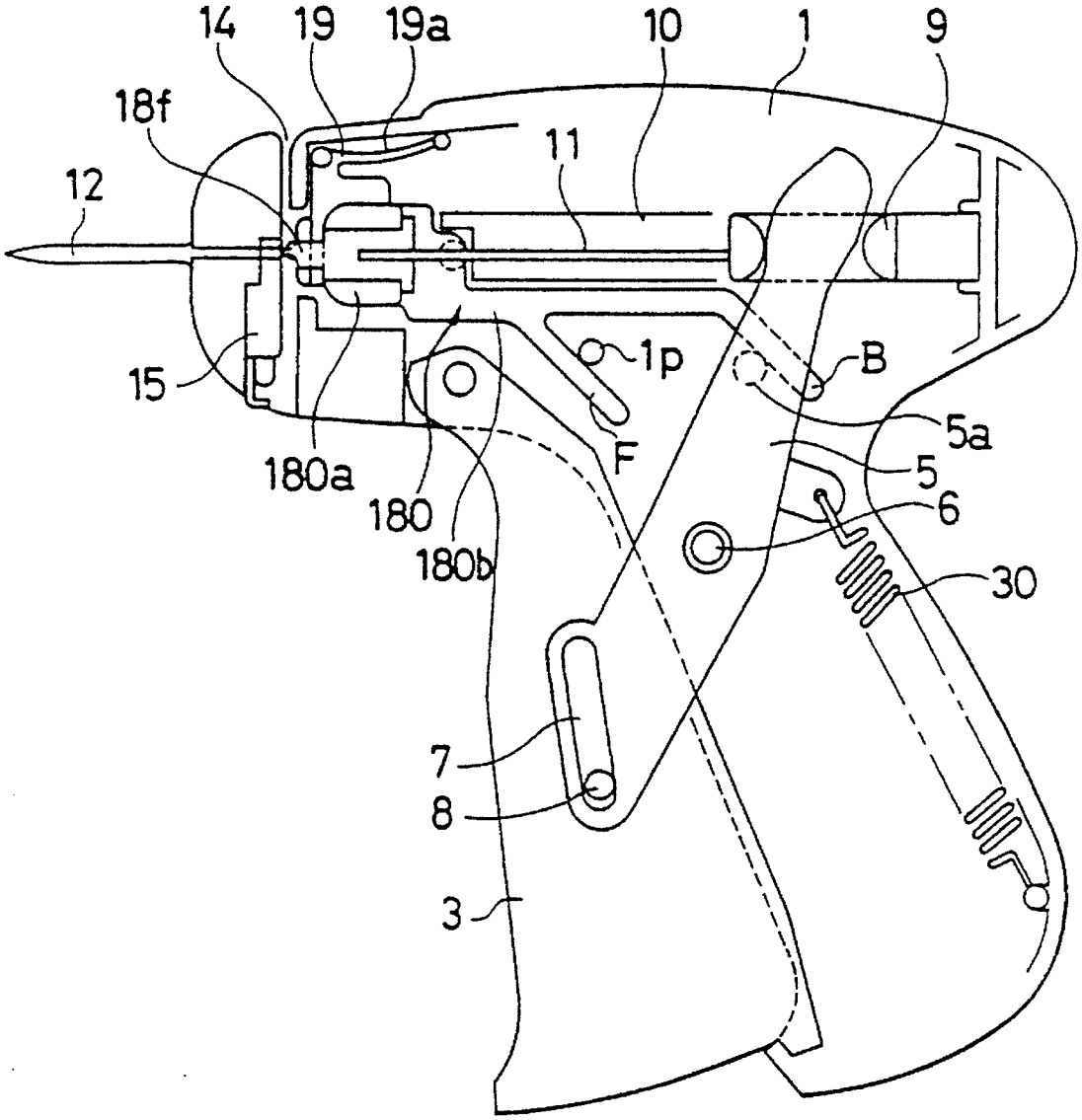
FIG. 10 is a side elevation, showing the structure inside the tag attacher according to another embodiment of the present invention.
Figure 11:
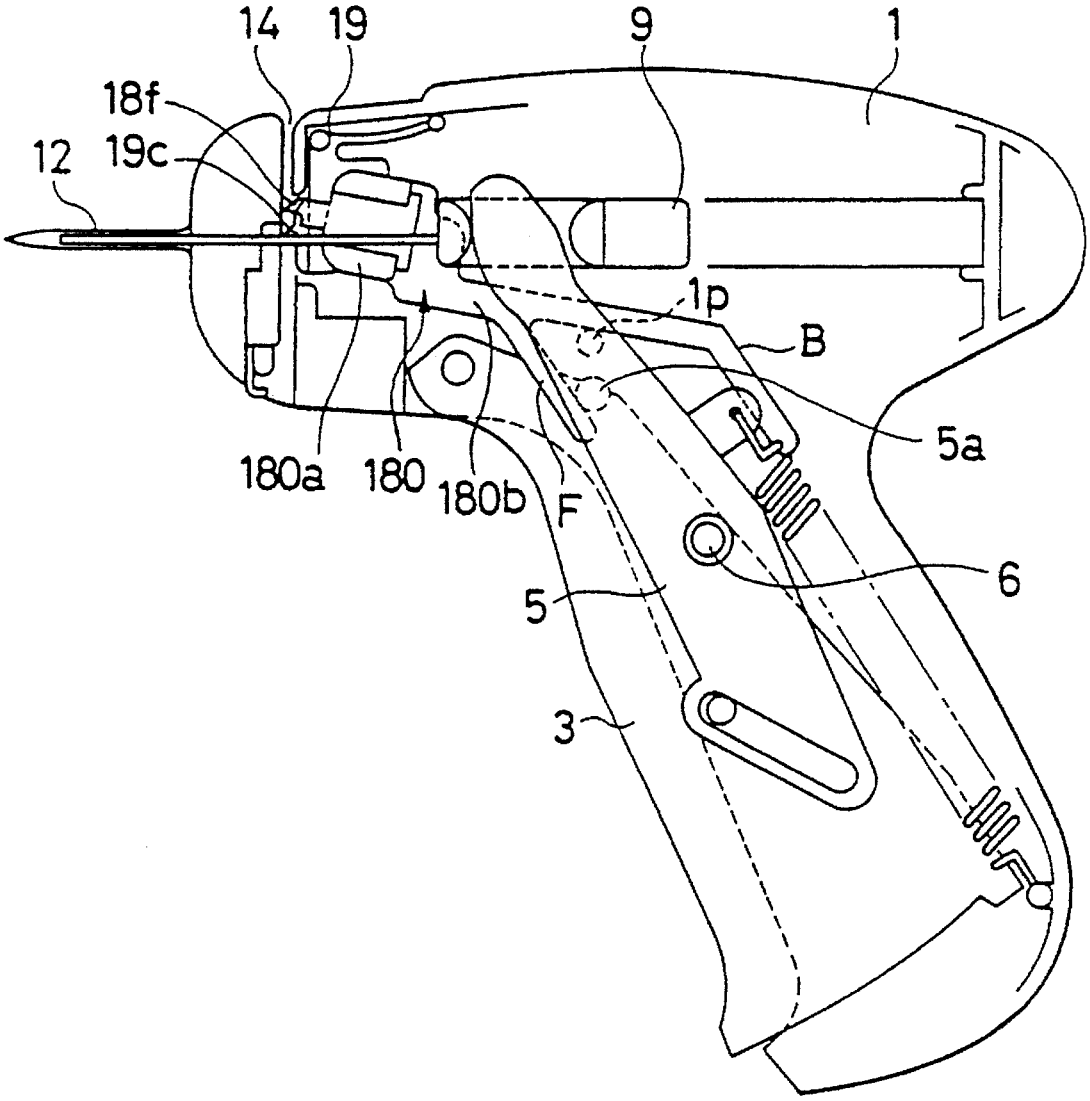
FIG. 11 is a view, taken for illustration of the operation of the tag attacher of FIG. 10.

FIG. 10 and FIG. 11 are side elevational views, showing structural details inside the tag attacher according to a second embodiment of the present invention, and in greater detail, while FIG. 10 shows an operation condition in preparation for the shooting of a tag pin, FIG. 11 shows the operation condition in which the shooting of a tag pin is completed.

Now, FIG. 10 and FIG. 11 may be put to a comparison respectively with the earlier considered FIG. 1 and FIG. 4 and it will be seen that the tag attacher of the present embodiment compares to the tag attacher of the first embodiment with respect to the structural feature that the feed member shown at 180 comprises a head portion 180*a*, a lever portion 180*b*, a boss 5*a* provided on an inner or a rear side of the intermediate lever 5 and a boss 1*p* provided to project from the attacher body 1. In the present second embodiment, however, the lever portion 180*b* has a front arm F and a rear arm B which are projected in a direction toward the intermediate lever 5, and on the inner wall of the machine body 1, the boss 1*p* is projected to restrict the range in which the lever portion 180*b* can rockably move. Also, with the rear arm B contacted against the boss 5*a* provided on the rear side of the intermediate lever 5, the head portion 180*a* is downwardly inclined to press a tag pin downwardly.

As seen from FIG. 11, an arrangement is made such that intermediately at the time of shooting a tag pin t, the front arm F is pressed downwardly in contact with the boss 5*a* to bring the head portion 180*a* to an upwardly inclined position and bring the tooth 18*f* to engage an upper located connecting portion c. In the condition shown in FIG. 11, the shooting of a first tag pin t is completed, and when the gripping force at the lever 3 is removed, the intermediate lever 5 can return to its original position on account of the spring force of the spring 30, when the lever 3 and the movable member 9 operatively in association with the intermediate lever 5 undergo a returning motion and the head portion 180*a* of the feed member 180 is downwardly pivoted from its position shown in FIG. 11 to the position shown in FIG. 10 and, in a condition of the tooth 18*f* engaged with the connecting portion c, the tag pin assembly T is lowered a distance corresponding to a single tag pin pith to arrive at the operation condition in preparation for the shooting of a tag pin.

The earlier described first embodiment represents such a mechanism in which the feed member 18 is rockably moved with the lever portion 18*b* contacting against the pressing member 9*a* provided to the movable member 9. In the present second embodiment, the arrangement is such that the intermediate lever 5 is contacted against the lever portion 180*b* of the feed member 180 to rockably move the feed member 180, but it is not limitative and, in essence, the mechanism may be such that it can impart to the feed member 180 a pivotal motion in accordance with the motion of the lever 3.

The tag attacher according to the present invention is constructed so that the movable member 9 having the piston 11 at the front portion thereof is moved forward by the intermediate lever 5 which is adapted to be rocked by the lever 3 supported pivotably so as to project forward from and retract into the grip 2 extended downward from the tag attacher body 1, to insert the lateral bar portion b of a tag pin t by the piston 11 into the hollow needle 12, in which tag attacher the feed member 18 from which the tooth 18*f* engageable with the connecting portion c of the tag pin t projects and, at a side of the tooth 18*f*, the stopper member 19 from which the tooth 19*c* engageable in parallel with the tooth 18*f* with the connecting portion c projects are provided in parallel with each other, the feed member 18 having the head portion 18*a* and lever portion 18*b* extended from the head portion 18*a*, the feed member 18 being pivoted in accordance with the forward and backward movements of the movable member 9 or the intermediate lever 5 so as to transfer the tag pin t to a predetermined position.

Therefore, one tag pin t can be transferred by the tooth 18*f* provided on the head portion 18*a* of the feed member 18 by pivoting the feed member 18 by reciprocating the movable member 9 by operating the lever 3, so that a tag attacher having a very simple feed means can be obtained.

Since the parts constituting the feed means are extremely omitted, a tag pin driving error ascribable to the errors of such parts can be prevented, and a highly durable tag attacher can be provided.

Since the number of parts is small, the number of metal molds for molding the parts can be reduced, and the materials can be saved. This enables a tag attacher of a lower price to be provided.

What is claimed is:

1. A tag attacher comprising:

a movable member having a piston at a front portion thereof;

wherein said movable member is moved forward by an intermediate lever;

wherein said intermediate lever is pivoted by a lever supported pivotally so as to project by spring force forward from and retract into a grip, so as to drive a lateral bar portion (b) of a tag pin (t) by said piston into a hollow needle;

wherein said grip is extended downward from a tag attacher body;

a feed member from which a tooth engageable with a connecting portion (c) of a tag pin (t) projects;

a stopper member from which a second tooth engageable, in parallel with said tooth, with said connection portion, projects;

wherein said feed member and said stopper member are provided in parallel with each other;

wherein said feed member comprises a head portion, a lever portion extended from said head portion to an opposite side of said tooth, and a receiving portion, altogether integrally formed from a synthetic resin; and wherein said lever portion and said receiving portion are alternately pressed directly in accordance with forward and backward movements of said movable member, whereby said head portion is pivoted to transfer said tag pin (t) to a predetermined position.

2. A tag attacher according to claim 1, wherein said feed member tooth s superposed on said head portion and wherein said feed member tooth is urged by a spring so as to project forward.

3. A tag attacher according to claim 1, wherein said lever portion of said feed member is disposed substantially in parallel with a guide groove along which said movable member having said piston at the front portion thereof is guided.

4. A tag attacher according to claim 1, wherein said tag attacher body further comprises a second stopper member for limiting a downward movement of said lever portion, and a third stopper member for limiting a downward movement of said head portion.

5. A tag attacher according to claim 1, wherein said lever portion being formed in a curved shape in the form of a bow of a pair of spectacles.

6. A tag attacher comprising:

a movable member having a piston at a front portion thereof;

wherein said movable member is moved forward by an intermediate lever;

wherein said intermediate lever is pivoted by a lever supported pivotally so as to project by spring force forward from and retract into a grip, so as to drive a lateral bar portion (b) of a tag pin (t) by said piston into a hollow needle;

wherein said grip is extended downward from a tag attacher body;

a feed member supported pivotally on a tag attacher body and a stopper member, provided on one side of a guide groove in which a tag pin assembly (T) is loaded;

wherein said feed member comprises a head portion, a lever portion extended from said head portion, and a receiving portion, altogether integrally formed from a synthetic resin;

wherein said feed member has a tooth formed at the front end of said head portion so as to project into said guide groove; and wherein said stopper member is supported pivotally on said tag attacher body and urged toward said guide groove and has a second tooth projecting into said guide groove.

* * * * *